US008345075B2

(12) United States Patent
Dontula et al.

(10) Patent No.: US 8,345,075 B2
(45) Date of Patent: Jan. 1, 2013

(54) DUPLEX THERMAL DYE RECEIVER ELEMENTS AND IMAGING METHODS

(75) Inventors: Narasimharao Dontula, Rochester, NY (US); Richard S. Paoletti, Spencerport, NY (US); Steven J. Tomanovich, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 55 days.

(21) Appl. No.: 13/094,935

(22) Filed: Apr. 27, 2011

(65) Prior Publication Data

US 2012/0274719 A1 Nov. 1, 2012

(51) Int. Cl.
*B41J 2/315* (2006.01)

(52) U.S. Cl. ..... 347/171

(58) Field of Classification Search ..... 347/171, 347/172–175, 103, 155; 400/120.02, 120.03, 400/120.04; 503/227
See application file for complete search history.

(56) References Cited

U.S. PATENT DOCUMENTS

| | | | | |
|---|---|---|---|---|
| 4,778,782 | A | 10/1988 | Ito et al. | |
| 5,176,974 | A * | 1/1993 | Till et al. | 347/155 |
| 5,264,873 | A * | 11/1993 | Fiscella et al. | 347/172 |
| 5,266,550 | A | 11/1993 | Asajima et al. | |
| 5,665,514 | A | 9/1997 | Shirai et al. | |
| 5,856,268 | A | 1/1999 | Takao | |
| 6,228,805 | B1 | 5/2001 | Ohshima et al. | |
| 6,703,088 | B2 | 3/2004 | Hayashi et al. | |
| 6,873,348 | B1 * | 3/2005 | Isono et al. | 347/171 |
| 7,091,157 | B2 | 8/2006 | Kung et al. | |
| 7,838,106 | B2 | 11/2010 | Dontula et al. | |
| 2004/0090508 | A1 * | 5/2004 | Chowdry et al. | 347/103 |
| 2008/0220190 | A1 | 9/2008 | Majumdar et al. | |
| 2009/0061124 | A1 | 3/2009 | Koide et al. | |
| 2010/0327480 | A1 | 12/2010 | Dontula | |
| 2010/0330306 | A1 | 12/2010 | Dontula et al. | |

FOREIGN PATENT DOCUMENTS

| | | |
|---|---|---|
| EP | 0 495 617 | 4/1995 |
| EP | 2 399 752 | 12/2011 |
| JP | 2002-154274 | 5/2002 |
| JP | 2002-169319 | 6/2002 |

OTHER PUBLICATIONS

U.S. Appl. No. 12/581,921, filed Oct. 20, 2009, entitled Thermal Dye Image Receiver Elements, by D. Majumdar et al.

* cited by examiner

*Primary Examiner* — Kristal Feggins
(74) *Attorney, Agent, or Firm* — J. Lanny Tucker

(57) ABSTRACT

A duplex thermal dye transfer element has a substrate, a non-voided compliant layer and a thermal dye image receiving layer. These imaging elements can be imaged on either or both sides in combination with one or more thermal dye donor elements in a thermal dye transfer process. Imaging can form a dye image or transfer clear films or laminates or metalized layers to either or both sides of the substrate.

24 Claims, No Drawings

DUPLEX THERMAL DYE RECEIVER ELEMENTS AND IMAGING METHODS

FIELD OF THE INVENTION

The present invention relates to duplex thermal dye transfer receiver elements in which thermal dye images, metals, or clear films can be printed on either or both sides of the substrate. The invention also provides thermal imaging assemblies comprising the duplex thermal dye transfer receiver element as well as methods of imaging (printing) the receiver element.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye-donor element is placed face-to-face with a dye receiver element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other colors. A color hard copy is thus obtained which corresponds to the original picture viewed on a screen.

Dye receiver elements used in thermal dye transfer generally include a support (transparent or reflective) bearing on one side thereof a dye image-receiving layer, and optionally additional layers, such as a compliant or cushioning layer between the support and the dye receiving layer. The compliant layer provides insulation to keep heat generated by the thermal head at the surface of the print, and also provides close contact between the donor ribbon and receiving sheet which is essential for uniform print quality.

Copending and commonly assigned U.S. Ser. Nos. 12/490,455 and 12/490,464 (both filed Jun. 24, 2009 by Dontula et al.) describe imaging elements having multiple extruded layers included extruded compliant and antistatic subbing layers. U.S. Patent Application Publication 2008/0220190 (Majumdar et al.) describes image recording elements comprising a support having thereon an aqueous subbing layer and an extruded dye receiving layer.

Copending and commonly assigned U.S. Ser. Nos. 12/581,921 (filed Oct. 20, 2009 by Majumdar, Honan, and Weidner) and 12/490,464 (filed Jun. 24, 2009, by Dontula, Chang, and Thomas) describe thermal dye transfer receiver elements that include an extruded compliant layer and an antistatic layer adhering it to an image receiving layer.

U.S. Pat. No. 5,266,550 (Asajima et al.) describes heat transfer image-receiving sheets having matted dye-receiving layers on both sides of the substrate to reduce the traces of image from one side being transferred to the other side. Polyurethane resin intermediate layers can be located under the matted dye-receiving layers.

Double-side thermal printing is described in U.S. Pat. No. 6,228,805 (Ohshima et al.) in which a thermal transfer printing sheet is printed in an apparatus having a rotary holder to change the sides of the printing sheet for printing.

There is a need for improved duplex thermal dye transfer receiver elements that can be thermally printed on both sides with reduced image defects caused especially by transport rollers in a thermal printer.

SUMMARY OF THE INVENTION

This invention provides a duplex thermal dye transfer receiver element comprising a substrate and on both surfaces, the following layers in the same order:

a non-voided compliant layer, and a thermal dye image receiving layer, and optionally a skin layer on either or both sides of the non-voided compliant layer, wherein the extruded, non-voided compliant layer has a heat of fusion of up to and including 45 joules/g of compliant layer as determined in a temperature range of at least 25° C. and up to and including 147° C. by ASTM method D3418-08, and a tensile modulus value of at least $7\times10^7$ and up to and including $5\times10^{10}$ dynes/cm$^2$.

This invention also provides an assembly comprising the duplex thermal dye transfer receiver element of this invention in thermal association with a thermal dye donor element.

Moreover, a method of this invention for forming a thermal dye image comprises imaging the duplex thermal dye transfer receiver element of this invention in thermal association with a thermal dye donor element.

The present invention provides advantages for the thermal dye image transfer art. Metal capstan rollers can still be used to transport the duplex thermal dye transfer elements through an imaging apparatus or printer, but the gouge or capstan roller marks normally caused in dye images in thermal dye donor elements are minimized. This is possible by using a particular type of compliant layer under the thermal dye image receiving layer on both sides of the substrate of the duplex thermal dye transfer receiver elements. Thus, images with minimal defects can be printed onto both sides of the substrate of the thermal dye donor elements.

Alternatively or additionally, very thin metal layers or metal patterns can be printed on one or both sides of the donor element substrate without showing tiny pinholes because of capstan roller marks. If desired, metal layers or patterns can be printed over dye images to provide unique effects in the dye images. In addition, clear films or protective "laminates" can be thermally transferred to either or both sides of the substrate, for example or dye image or metal layers or metal patterns.

Additional advantages are provided by this invention because a manufacturer can provide a duplex thermal dye transfer receiver element in a single-pass operation for each side if the thermal dye image receiving layer and non-voided compliant layer are co-extruded. High quality dye or metalized images, with minimal image defects, can also be provided by this invention by transferring from a suitable thermal dye donor element. These advantages are achieved by designing the non-voided compliant layer to have a particular heat of fusion and tensile modulus on both sides of the substrate.

DETAILED DESCRIPTION OF THE INVENTION

Definitions

Unless otherwise indicated, the terms "duplex thermal dye transfer receiver element", and "receiver element" refer to embodiments of the present invention.

By the term "duplex", we mean that both sides of the substrate (defined below) has a thermal dye image receiving layer (defined below) and therefore each side is capable of forming a dye image, although it is not required in the method of this invention that an image always be formed on both sides of the substrate.

The present invention relates to a multilayer element that is useful as duplex thermal dye transfer receiver (or recording) element. This receiver element includes two essential layers disposed in the same order on each side of the substrate, a thermal dye image receiving layer (IRL) and a non-voided compliant layer. The receiver element can also include, on each side of the substrate, optional skin layers (usually extruded) located immediately adjacent either or both sides of the non-voided compliant layer. In some embodiments, there can be an aqueous-coated layer (described below) between the non-voided compliant layer and the thermal dye image receiving layer. This aqueous-coated layer can also act as an antistatic layer if desired.

The term "thermal dye donor element" refers to an element (defined below) that can be used to thermally transfer a dye, ink, clear film, or metal. It is not necessary that each thermal dye donor element transfer only a dye or ink.

The duplex thermal dye transfer receiver element can be used in an assembly of this invention in combination or "thermal association" with one or more thermal dye donor elements to provide a dye image on one or more sides using thermal dye transfer. Multiple dye transfers to the same duplex thermal dye transfer receiver element can provide a multi-color image on one or both sides of the substrate. In addition or alternatively, a metal layer or pattern can be formed on one or both sides of the substrates. In addition, a clear layer (topcoat) can also be applied to one or both sides of the substrate, for example to cover a multicolor image on one or both sides of the substrate.

The term "thermal association" refers to two different elements that are disposed in a relationship that allows thermal transfer of a dye, metal, or thin film. Such relationship generally requires intimate physical contact of the two elements.

The term "non-voided" as used to refer to the compliant layer as being devoid of added solid or liquid matter that cause voids in the continuous layer phase, as well as devoid of voids containing a gas (such as polymeric vesicles).

The term "extruded" refers to a layer that is applied using known extrusion techniques as opposed to being coated out of an aqueous or organic solvent coating formulation.

The term "aqueous-coated" refers to a layer that is applied or coated out of an aqueous coating formulation.

Unless otherwise indicated, the term "polymer" and "resin" mean the same.

Non-Voided Compliant Layer

The non-voided compliant layer used in the imaging element can be provided from one or more resins such as a blend of resins. The compliant layer is generally an extruded layer. In some embodiments, the compliant layer comprises multiple resins that include one or more elastomeric resins, one or more amorphous or semi-crystalline polymers, and one or more matrix polymers.

Useful elastomeric resins include but not limited to, thermoplastic elastomers like polyolefin blends, styrene/alkylene block copolymers (SBC) [such as styrene-ethylene/butylene-styrene (SEBS), styrene-ethylene/propylene-styrene (SEPS), styrene-butadiene-styrene (SBS), and styrene-isoprene-styrene (SIS)], polyether block polyamide (Pebax® type polymers), thermoplastic copolyester elastomer (COPE), thermoplastic urethanes (TPU), and polyolefins such as ethylene/propylene copolymers (for example, available as Vistamaxx™ polymers). Mixtures of the same or different types of elastomeric resins can be used. One or more elastomeric resins are present in the extruded layer in amount of at least 5 weight % and up to and including 30 weight %, or typically at least 10 and up to and including 25 weight %.

Useful amorphous or semi-crystalline polymers include but are not limited to, cyclic olefins, polystyrenes, maleated polyethylene (such as Dupont Bynel® grades, Arkema's Lotader® grades) that can be present in the extruded layer in an amount of at least 2 weight % and up to and including 25 weight %, or typically at least 5 and up to and including 20 weight %.

Useful "matrix" polymers are not generally elastomeric. Such polymeric materials include but are not limited to, polyolefins such as polyethylene, polypropylene, and their copolymers, functionalized or grafted polyolefins, polystyrenes, polyamides like amorphous polyamide (like Selar), and polyesters. The amount of one or more matrix polymers in the extruded compliant layer is generally at least 35 and up to and including 80 weight % or typically at least 40 and up to and including 65 weight %.

Depending on the manufacturing process and thickness of the non-voided compliant layer, the various types of resins are used individually or in mixtures or blends. For example, useful non-voided compliant layer resin blends include blends of ethylene/ethyl acrylate copolymers (EEA), ethylene/butyl acrylate copolymers (EBA), or ethylene/methyl acrylate copolymers (EMA) with SEBS like Kraton® G1657M; EEA, EBA, or EMA with SEBS and polypropylene; EEA, EBA, or EMA polymers with SEBS and polystyrene; EEA or EMA with SEBS and cyclic polyolefins (like Topas® resins); polypropylene with Kraton® polymers like FG1924, G1702, G1730M; polypropylene with ethylene propylene copolymers like Exxon Mobil's Vistamaxx grades; or blends of low density polyethylene (LDPE) with amorphous polyamide like Dupont's Selar and Kraton® FG grade of polymers and an additive compound such as maleated polyethylene (Dupont Bynel® grades, Arkema's Lotader® grades).

For example, some non-voided compliant layers include combinations of polymers such as at least 40 and up to and including 65 weight % of a matrix polymer, at least 5 and up to and including 30 weight % of an elastomeric polymer, and at least 2 and up to and including 25 weight % of an amorphous or semi-crystalline polymer. The weight ratio of the three components can be varied and optimized based on the layer structure and the resins used.

Desirably, the non-voided compliant layer alone has a heat of fusion (enthalpy of fusion) equal to or greater than 0 and up to and including 45 joules/g of compliant layer, or at least 5 and up to and including 45 joules/g (J/g) of compliant layer, as determined in the temperature range of at least 25° C. and up to and including 147° C. by ASTM Method D3418-08 ("Standard Test Method for Transition Temperatures and Enthalpies of Fusion and Crystallization of Polymers by Differential Scanning calorimetry").

In addition, the non-voided compliant layer alone has a tensile modulus value of less than $5\times10^{10}$ dynes/cm$^2$, or at least $7\times10^7$ and up to and including $5\times10^{10}$ dynes/cm$^2$, as determined using a Rheometric Solids Analyzer over a temperature range of at least 25° C. and up to and including 140° C. at a frequency of 1 Hz with a temperature change rate of 2° C./min. Each measurement described below was made at 25° C. in tensile mode using a 30×8 ×0.04 mm sample with an applied strain of 0.5% and a static force of 25 g.

In some embodiments, the non-voided compliant layer alone has a heat of fusion of from 0 and up to and including 30 joules/g (in the temperature range of 25° C. to 147° C.) and a tensile modulus value of at least $1\times10^9$ and up to and including $5\times10^{10}$ dynes/cm$^2$ to provided optimum print density (specifically $D_{max}$) of the transferred image.

The resin compositions in the non-voided compliant layer are optimized for printer performance as well as enabling manufacture at high speeds using a high temperature process like extrusion coating. Extrusion requires that the resins have thermal stability, have the ability to be drawn down, have the appropriate shear viscosity and melt strength, and have good release from a chill roll. The shear viscosity range of the compliant layer resins and resin blends should be at least 1,000 poise and up to and including 100,000 poise at 200° C. at a shear rate of 1 $s^{-1}$, or at least 2,000 poise and up to and including 50,000 poise at 200° C. at a shear rate of 1 $s^{-1}$.

Other embodiments of the non-voided compliant layer comprise uni- or biaxially-oriented polypropylene, poly(ethylene terephthalate), polylactic acid, and other known polyolefin and polyester films. The amount of such polymers in the non-voided compliant layer can be at least 75 weight % and up to and including 100 weight % based on total dry layer weight. In addition, this layer can include one or more elastomeric resins (as defined above) in an amount of up to and including 25 weight %, based on total dry layer weight. These layers can be applied by extrusion or solvent coating techniques known in the art.

The dry thickness of the non-voided compliant layer is generally at least 15 and up to and including 70 μm or typically at least 20 and up to and including 45 μm. It can be advantageous in various embodiments that the dry thickness ratio of the non-voided compliant layer (on each side of the substrate) to the substrate is at least 0.08:1 and up to and including 0.5:1 or at least 0.1:1 and up to and including 0.33:1.

If the non-voided compliant layer is applied by extrusion, the formulation can be applied using high temperature extrusion processes like cast extrusion or extrusion coating or hot melt at a temperature of at least 200 and up to and including 285° C. at an extrusion speed of at least 0.0508 in/sec and up to and including 5.08 msec. Useful extrusion speeds are high speeds due to productivity constraints and for economical reasons. In some instances, the resulting extruded, non-voided compliant layer can have a thickness greater than the final thickness obtained at slow speeds, but it is then stretched or made thinner by an orientation process that results in coating on a support at a higher speed. A less desirable variation of the orientation process is biaxial orientation of the extruded, non-voided compliant layer and laminating it to a support. The choice of manufacturing operation would be dependent upon the choice of compliant layer composition. For example, using polypropylene as the matrix material makes it possible to use either extrusion coating or an unaxial or biaxial orientation process.

As described in more detail below, the non-voided compliant layer can be formed by co-extrusion with one or more extruded skin layers immediately adjacent either or both sides of the non-voided compliant layer as described below.

The non-voided compliant layer can also include additives such as opacifiers like titanium dioxide and calcium carbonate, colorants, dispersion aids like zinc stearate, chill roll release agents, antioxidants, UV stabilizers, and optical brighteners. However, such additives are not used if they would cause voids within the non-voided compliant layer.

The non-voided compliant layer on both sides of the substrate can have the same or different composition and additives.

Skin Layer(s)

The imaging element can also include one or more skin layers, on either or both sides of the non-voided compliant layer. Usually a skin layer is at least between the substrate and the non-voided compliant layer. Such skin layers can be composed of polyolefins such as polyethylene, copolymers of ethylene, like ethylene/methyl acrylate (EMA) copolymers, ethylene/butyl acrylate (EBA) copolymers, ethylene/ethyl acrylate (EEA) copolymers, ethylene/methyl acrylate/maleic anhydride copolymers, or blends of these polymers. The acrylate content in the skin should be so adjusted that it does not block in roll form, or antiblock additives can be added to the layer formulation. Thermoplastic elastomers (as described above for the extruded, non-voided compliant layer) can be present in the skin layers if desired.

The thickness of the image side skin layer can be up to and including 10 μm, and typically up to and including 8 μm. The resin choice and the overall composition of the topmost surface of the substrate is optimized to obtain good adhesion to the non-voided compliant layer and to enable good chill roll or casting wheel release.

A skin layer on the substrate side of the non-voided compliant layer can be similarly composed and can have a thickness of up to and including 25 μm, and typically up to and including 15 μm.

The skin layers can be extruded individually at high temperatures of from about 200 to about 285° C. at speeds of from about 0.0508 m/sec to about 5.08 msec. Alternatively, they can be co-extruded (extruded simultaneously) with the non-voided compliant layer and cast on a chill roll, casting wheel, or cooling stack. A particularly useful configuration is the presence of a skin layer between the non-voided compliant layer and the substrate. Another useful configuration for this invention omits skin layers. When one or more skin layers are present, the total heat of fusion of skin and non-voided compliant layers together can satisfy the heat of fusion values described above for the non-voided compliant layer alone. It is also desirable that the skin layer(s) and non-voided compliant layer together satisfy the modulus values described above for the non-voided compliant alone.

Thermal Dye Image Receiving Layer

The thermal dye image receiving layer used in the imaging element can be formed in any suitable manner, for example using solvent or aqueous coating techniques such as curtain coating, dip coating, solution coating, printing, or extrusion coating as is known in the art, for example in U.S. Pat. Nos. 5,411,931 (Kung), 5,266,551 (Bailey et al.), 6,096,685 (Pope et al.), 6,291,396 (Bodem et al.), 5,529,972 (Ramello et al.), and 7,485,402 (Arai et al.).

In most embodiments, the thermal dye image receiving layer is extruded onto the non-voided compliant layer. For example, they can be co-extruded layers with the non-voided compliant layer or skin layers. The details of such thermal dye image receiving layers are provided for example in U.S. Pat. No. 7,091,157 (Kung et al.) that is incorporated herein by reference. Further details about imaging receiving layers can be obtained from copending and commonly assigned U.S. Ser. Nos. 12/490,455 and 12/490,464 (noted above) that are also incorporated herein by reference. For example, such layers can comprise, for example, polycarbonate, polyurethane, polyester, vinyl polymer [such as a polyolefin, polyvinyl chloride, or poly(styrene-co-acrylonitrile)], poly(caprolactone), or mixtures or blends thereof.

The thermal dye image receiver layer generally can be extruded at a thickness of at least 100 μm and typically at least 100 and up to and including 800 μm, and then uniaxially stretched to less than 10 μm. The final thickness of the thermal dye image receiving layer is generally of at least 1 and up to and including 10 μm, and typically of at least 1 μm and up to and including 5 μm with the optimal thickness being determined for the intended purpose. The coverage for example can be at least 0.5 and up to and including 20 g/m$^2$ or typically at least 1 and up to and including 10 g/m$^2$.

It can be sometimes desirable for the thermal dye image receiving layer to also comprise other additives such as lubricants that can enable improved conveyance through a printer. An example of a lubricant is a polydimethylsiloxane-containing copolymer such as a polycarbonate random terpolymer of bisphenol A, diethylene glycol, and polydimethylsiloxane block unit and can be present in an amount of at least 3% and up to and including 30% by weight of the image receiving layer. Other additives that can be present are plasticizers such as esters or polyesters formed from a mixture of 1,3-butylene glycol adipate and dioctyl sebacate. The plasticizer would typically be present in an amount of at least 1% and up to and including 20% by total weight of the thermal dye image receiving layer.

A thermal dye image receiving layer is present on both sides of the support, and can be single- or multi-layered. Thus, images can be formed on both sides of the receiving element.

The dry thickness ratio of the thermal dye image receiving layer to the non-voided compliant layer (on each side of the element) is generally of at least 0.04:1 and up to and including 0.3:1 or typically of at least 0.06:1 and up to and including 0.2:1.

Preparation of Various Layers in Receiver Element

According to some embodiments of the invention, a skin layer can be formed on either or both surfaces of the non-voided compliant layer. The skin layer can be individually extruded onto the substrate described below by any of the extrusion methods like extrusion coating or cast extrusion or hot melt extrusion. In these methods, the polymer or resin blend is melted in the first step. In a second step, the melt is homogenized to reduce temperature excursions or adjusted and delivered to the die. In a third step, the skin layers are delivered onto a substrate or a modified substrate and rapidly quenched below their transition temperature (melting point or glass transition) so as to attain rigidity. For the skin layer closer to the substrate, the resin can be delivered onto the substrate while the skin layer closer to the thermal dye image receiving layer can be delivered onto the non-voided compliant layer that has been extruded onto a substrate (this is known as modified substrate).

Instead of laying down the skin layer(s) individually that requires multiple stations or multiple operations, a useful method of laying down the skin layer(s) is simultaneously with the compliant layer. This is typically known as multi-layer co-extrusion. In this method, two or more polymers or resin formulations are extruded and joined together in a feedblock or die to form a single structure with multiple layers. Typically, two basic die types are used for co-extrusion: multi-manifold dies and feedblock with a single manifold die although hybrid versions exist that combine feedblocks with multi-manifold dies. In the case of a multi-manifold die, the die has individual manifolds that extend its full width. Each of the manifolds distributes the polymer layer uniformly. The combination of the layers (in this case skin(s) with the compliant layer) might occur inside the die before the final die land or outside the die. In the case of the feedblock method, the feedblock arranges the melt stream in the desired layer structure prior to the die inlet. A modular feedblock design along with the extruder flow rates enables the control of sequence and thickness distribution of the layers.

Overall in a first step for creating the skin layer(s), the polymer or resin blend composition is melted and delivered to the co-extrusion configuration. Similarly for the non-voided compliant layer, the resin blend composition is melted and delivered to the co-extrusion configuration. To enable good spreading and layer uniformity, the skin layer viscosity characteristics should not be more than 10 times or 1:10, or not more than 3 times or less than 1:3 difference in viscosity from that of the melt that forms the compliant layer. This promotes efficient and high quality co-extrusion and avoids nonuniform layers. Layer uniformity can be adjusted by varying melt temperature. To enable good interlayer adhesion, material composition can be optimized, layer thickness can be varied, and also the melt temperature of the streams adjusted in the co-extrusion configuration.

The co-extruded layers can be stretched or oriented to reduce the thickness. In a fourth step, the extruded and stretched layers are applied to the support described below while simultaneously reducing the temperature within the range below the melting temperature (TO or glass transition temperature ($T_g$) of the skin layer(s), for example, by quenching between two nip rollers that can have the same or different finish such as matte, rough glossy, or mirror finish.

In addition, the skin layers can be extruded separately (as noted above), or co-extruded with one or more of the other layers. A modification of post-processing co-extruded layers is a process to form the laminate. The co-extruded layers are quenched against a chill roller or between two nip rollers and then they are oriented monoaxially using a machine direction orienter (MDO) or oriented biaxially using an MDO and tenter frame in sequence or using a simulstretcher.

When the thermal dye image receiving layer is solvent or aqueous coated it can be crosslinked during the coating or drying operation or crosslinked later by an external means like UV irradiation.

Receiver Element Structure and Supports

The particular structure of a duplex thermal dye transfer receiver element of the present invention can vary, but it is generally a multilayer structure on both sides of the substrate and consists essentially of, under the thermal dye image receiving layer, in order, an optional skin layer, a non-voided compliant layer, an optional skin layer, and a substrate (defined as all layers below the extruded compliant layer) that comprises a base support, such as a raw paper stock comprising cellulose fibers, a synthetic paper comprising synthetic polymer fibers, or a resin coated paper. But other base supports such as fabrics and polymer sheets can be used. The base support can be any support typically used in imaging applications. Any of the duplex thermal dye transfer receiver elements of this invention could further be laminated to a substrate or support to increase the utility of the duplex thermal dye transfer receiver element.

The resins used on the bottom or wire side (backside) of the paper base are thermoplastics like polyolefins such as polyethylene, polypropylene, copolymers of these resins, or blends of these resins. The thickness of the resin layer on the bottom side of the raw base can range from at least 5 μm and up to and including 75 μm and typically of at least 10 μm and up to and including 40 μm. The thickness and resin composition of the resin layer can be adjusted to provide desired curl characteristics. The surface roughness of this resin layer can be adjusted to provide desired conveyance properties in imaging printers.

The base support can be transparent or opaque, reflective or non-reflective. Opaque supports include plain paper, coated paper, resin-coated paper such as polyolefin-coated paper, synthetic paper, low density foam core based support, and low density foam core based paper, photographic paper support, melt-extrusion-coated paper, and polyolefin-laminated paper.

The papers include a broad range of papers, from high end papers, such as photographic paper to low end papers, such as newsprint. In one embodiment, Ektacolor® paper made by Eastman Kodak Co. as described in U.S. Pat. Nos. 5,288,690 (Warner et al.) and 5,250,496 (Warner et al.), both incorporated herein by reference, can be employed. The paper can be made on a standard continuous fourdrinier wire machine or on other modern paper formers. Any pulp known in the art to provide paper can be used. Bleached hardwood chemical kraft pulp is useful as it provides brightness, a smooth starting surface, and good formation while maintaining strength. Papers useful in this invention are generally of caliper of at least 50 μm and up to and including 230 μm and typically at least 100 μm and up to and including 190 μm, because then the overall imaged element thickness is in the range desired by customers and for processing in existing equipment. They can be "smooth" so as to not interfere with the viewing of images. Chemical additives to impart hydrophobicity (sizing), wet strength, and dry strength can be used as needed. Inorganic filler materials such as $TiO_2$, talc, mica, $BaSO_4$ and $CaCO_3$ clays can be used to enhance optical properties and reduce cost as needed. Dyes, biocides, and processing chemicals can also be used as needed. The paper can also be subject to smoothing operations such as dry or wet calendering, as well as to coating through an in-line or an off-line paper coater.

A particularly useful support is a paper base that is coated with a resin on either side. Biaxially oriented base supports include a paper base and a biaxially oriented polyolefin sheet, typically polypropylene, laminated to one or both sides of the paper base. Commercially available oriented and non-oriented polymer films, such as opaque biaxially oriented polypropylene or polyester, can also be used. Such supports can contain pigments, air voids or foam voids to enhance their opacity. The base support can also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861 that is incorporated herein by reference. Microvoided composite biaxially oriented sheets can be utilized and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616 (Ashcraft et al.), 4,758,462 (Park et al.), and 4,632,869 (Park et al.), the disclosures of which are incorporated by reference.

Unlike the non-voided compliant layer, the substrate can be voided, which means voids formed from added solid and liquid matter, or "voids" containing gas. The void-initiating particles, which remain in the finished packaging sheet core, should be from at least 0.1 and up to and including 10 μm in diameter and typically round in shape to produce voids of the desired shape and size. The size of the void is also dependent on the degree of orientation in the machine and transverse directions. Ideally, the void would assume a shape that is defined by two opposed, and edge contacting, concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

Biaxially oriented sheets, while described as having at least one layer, can also be provided with additional layers that can serve to change the properties of the biaxially oriented sheet. Such layers might contain tints, antistatic or conductive materials, or slip agents to produce sheets of unique properties. Biaxially oriented sheets can be formed with surface layers, referred to herein as skin layers, which would provide an improved adhesion, or look to the support and photographic element. The biaxially oriented extrusion can be carried out with as many as 10 layers if desired to achieve some particular desired property. The biaxially oriented sheet can be made with layers of the same polymeric material, or it can be made with layers of different polymeric composition. For compatibility, an auxiliary layer can be used to promote adhesion of multiple layers.

Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The term as used herein, "transparent" means the ability to pass visible radiation without significant deviation or absorption.

The substrate used in the invention can have a thickness of at least 50 and up to and including 500 μm or typically at least 75 and up to and including 350 μm. Antioxidants, brightening agents, antistatic or conductive agents, plasticizers and other known additives can be incorporated into the substrate, if desired. In one embodiment, the element has an L*UVO (UV out) of greater than 80 and a b*UVO of from 0to-6.0. L*, a* and b* are CIE parameters (see, for example, Appendix A in Digital Color Management by Giorgianni and Madden, published by Addison, Wesley, Longman Inc., 1997) that can be measured using a Hunter Spectrophotometer using the D65 procedure. "UV out" (UVO) refers to use of UV filter during characterization such that there is no effect of UV light excitation of the sample.

Useful antistatic agents in the substrate (such as a raw paper stock) include but are not limited to, metal particles, metal oxides, inorganic oxides, metal antimonates, inorganic non-oxides, and electronically conductive polymers, examples of which are described in copending and commonly assigned U.S. Ser. No. 12/581,921 (noted above) that is incorporated herein by reference. Particularly useful are inorganic or organic electrolytes. Alkali metal and alkaline earth salts (or electrolytes) such as sodium chloride, potassium chloride, and calcium chloride, and electrolytes comprising polyacids are useful. For example, alkali metal salts include lithium, sodium, or potassium polyacids such as salts of polyacrylic acid, poly(methacrylic acid), maleic acid, itaconic acid, crotonic acid, poly(sulfonic acid), or mixed polymers of these compounds. Alternatively, the raw base support can contain various clays such as smectite clays that include exchangeable ions that impart conductivity to the raw base support. Polymerized alkylene oxides, such as combinations of polymerized alkylene oxide and alkali metal salts as described in U.S. Pat. Nos. 4,542,095 (Steklenski et al.) and 5,683,862 (Majumdar et al.) are useful as electrolytes.

The antistatic agents can be present in the cellulose raw base support in an amount of up to 0.5 weight % or typically at least 0.01 and up to and including 0.4 weight % based on the total substrate dry weight.

In another embodiment, the base support comprises a synthetic paper that is typically cellulose-free, having a polymer core that has adhered thereto at least one flange layer. The polymer core comprises a homopolymer such as a polyolefin, polystyrene, polyester, polyvinylchloride, or other typical thermoplastic polymers; their copolymers or their blends thereof; or other polymeric systems like polyurethanes and polyisocyanurates. These materials can or can not have been expanded either through stretching resulting in voids or through the use of a blowing agent to consist of two phases, a solid polymer matrix, and a gaseous phase. Other solid phases can be present in the form of fillers that are of organic (polymeric, fibrous) or inorganic (glass, ceramic, metal) origin. The fillers can be used for physical, optical (lightness, whiteness, and opacity), chemical, or processing property enhancements of the core.

In still another embodiment, the support comprises a synthetic paper that can be cellulose-free, having a foamed polymer core or a foamed polymer core that has adhered thereto at least one flange layer. The polymers described for use in a polymer core can also be employed in manufacture of the foamed polymer core layer, carried out through several mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure, the volatilization of low-boiling liquids such as fluorocarbons or methylene chloride, or the incorporation of hollow microspheres in a polymer matrix. The choice of foaming technique is dictated by desired foam density reduction, desired properties, and manufacturing process. The foamed polymer core can comprise a polymer expanded through the use of a blowing agent.

In a many embodiments, polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbonamide, azobisformamide, azobisisobutyrolnitrile, diazoaminobenzene, 4,4'-oxybis(benzene sulfonyl hydrazide) (OBSH), N,N'-dinitrosopentamethyl-tetramine (DNPA), sodium borohydride, and other blowing agent agents well known in the art. Useful chemical blowing agents would be sodium bicarbonate/citric acid mixtures, azodicarbonamide; though others can also be used. These foaming agents can be used together with an auxiliary foaming agent, nucleating agent, and a cross-linking agent.

In those embodiments containing a unaxially or biaxially-oriented polypropylene, poly(ethylene terephthalate), or polylactic acid, in the non-voided compliant layer, the duplex thermal dye transfer receiver element includes an aqueous-coated layer between the non-voided compliant layer and the thermal dye image receiving layer. This aqueous-coated layer can be provided using a solution coating process such as gravure, slot, hopper, and rod coating processes. It can also include one or more antistatic agents such as is well known in the art.

Dye Donors Elements

Ink or thermal dye donor elements that can be used with the duplex thermal dye transfer element of this invention generally comprise a support having thereon an ink or dye containing layer.

Any ink or dye can be used in the thermal ink or dye donor provided that it is transferable to the thermal dye image receiving layer by the action of heat. Ink or thermal dye donor elements are described, for example, in U.S. Pat. Nos. 4,916,112 (Henzel et al.), 4,927,803 (Bailey et al.), and 5,023,228 (Henzel) that are all incorporated herein by reference. As noted above, ink or thermal dye donor elements can be used to form an ink or dye transfer image. Such a process comprises image-wise-heating an ink or thermal dye donor element and transferring an ink or dye image to either or both sides of the duplex thermal dye transfer element as described above to form the ink or dye transfer image on either or both sides. In the thermal ink or dye transfer method of printing, an ink or thermal dye donor element can be employed that comprises a poly(ethylene terephthalate) support coated with sequential repeating areas of cyan, magenta, or yellow ink or dye, and the ink or dye transfer steps can be sequentially performed for each color to obtain a multi-color ink or dye transfer image on either or both sides the duplex thermal dye transfer receiver element. The support can include a black ink. The thermal dye donor support can also include a clear protective layer that can be transferred onto the transferred dye images. When the process is performed using only a single color, then a monochrome ink or dye transfer image can be obtained.

Thermal dye donor elements that can be used with the duplex thermal dye transfer receiver element conventionally comprise a support having thereon a dye containing layer. Any dye can be used in the dye layer of the dye-donor element provided it is transferable to the dye-receiving layer by the action of heat. Especially good results have been obtained with diffusible dyes, such as the magenta dyes described in U.S. Pat. No. 7,160,664 (Goswami et al.) that is incorporated herein by reference.

The dye donor layer can include a single color area (patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include a magenta dye combination and further comprise a yellow dye-donor patch comprising at least one bis-pyrazolone-methine dye and at least one other pyrazolone-methine dye, and a cyan dye-donor patch comprising at least one indoaniline cyan dye.

Any dye transferable by heat can be used in the dye donor layer of the thermal dye donor element. The dye can be selected by taking into consideration hue, lightfastness, and solubility of the dye in the dye donor layer binder and the thermal dye image receiving layer binder.

Further examples of useful dyes can be found in U.S. Pat. Nos. 4,541,830 (Hotta et al.); 4,698,651 (Moore et al.); 4,695,287 (Evans et al.); 4,701,439 (Evans et al.); 4,757,046 (Byers et al.); 4,743,582 (Evans et al.); 4,769,360 (Evans et al.); 4,753,922 (Byers et al.); 4,910,187 (Sato et al.); 5,026,677 (Vanmaele); 5,101,035 (Bach et al.); 5,142,089 (Vanmaele); 5,374,601 (Takiguchi et al.); 5,476,943 (Komamura et al.); 5,532,202 (Yoshida); 5,804,531 (Evans et al.); 6,265,345 (Yoshida et al.); and 7,501,382 (Foster et al.), and U.S. Patent Application Publications 2003/0181331 (Foster et al.) and 2008/0254383 (Soejima et al.), the disclosures of which are hereby incorporated by reference.

The dyes can be employed singly or in combination to obtain a monochrome dye-donor layer or a black dye-donor layer. The dyes can be used in an amount of from about 0.05 $g/m^2$ to about 1 $g/m^2$ of coverage. According to various embodiments, the dyes can be hydrophobic.

Metal Transfer

The duplex thermal dye transfer receiver element of this invention can also receive a uniform or pattern-wise transfer of a metal including but not limited to, aluminum, copper, silver, gold, titanium nickel, iron, chromium, or zinc onto either or both sides of the substrate. Such metalized "layers" can be located over a single- or multi-color image, or the metalized layer can be the only "image" on the side. Metal-containing particles can also be transferred. Metals or metal-containing particles can be transferred with or without a polymeric binder. For example, metal flakes in a thermally softenable binder can be transferred as described for example in U.S. Pat. No. 5,312,683 (Chou et al.) that is incorporated herein by reference. The transfer of aluminum powder is described in U.S. Pat. No. 6,703,088 (Hayashi et al.). Multiple metals can be thermally transferred if desired to achieve a unique metallic effect. For example, one metal can be transferred to form a uniform metallic layer and a second metal is transferred to provide a desired pattern on the first metal layer.

Metals or metal-containing particles for transfer can be provided in ribbons or strips of such materials in a thermal donor element.

Imaging and Assemblies

As noted above, the dye donor elements and duplex thermal dye transfer receiver elements can be used to form a dye transfer image. Such a process comprises imagewise-heating a thermal dye donor element and transferring a dye or metal image to a duplex thermal dye transfer element as described above to form the dye or metal transfer image.

A thermal dye donor element can be employed which comprises a poly(ethylene terephthalate) support coated with sequential repeating areas of cyan, magenta and yellow dye, and the dye transfer steps are sequentially performed for each color to obtain a three-color dye transfer image on either or both sides of the substrate. The thermal dye donor element can also contain a colorless area that can be transferred to the duplex thermal dye transfer receiver element to provide a protective overcoat on either or both sides of the substrate. As noted above, the thermal dye donor element can also transfer a metal to either or both sides of the duplex thermal dye transfer receiver element.

Thermal printing heads which can be used to transfer ink, dye, metal, or a clear film from appropriate donor elements to the duplex thermal dye transfer receiver element can be available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for transfer can be used, such as lasers as described in, for example, GB Publication 2,083,726A that is incorporated herein by reference.

A thermal transfer assemblage can comprise (a) a thermal dye donor element, and (b) a duplex thermal dye transfer receiver element of this invention, the duplex thermal dye transfer receiver element being in a superposed relationship with the thermal dye donor element so that the dye or metal layer of the dye donor element can be in contact with the thermal dye image receiving layer. Imaging can be obtained with this assembly using known processes.

When a three-color image is to be obtained, the above assemblage can be formed on three different occasions during the time when heat can be applied by the thermal printing head. After the first dye is transferred, the elements can be peeled apart. A second thermal dye donor element (or another area of the thermal dye donor element with a different dye area) can be then brought in register with the thermal dye image receiving layer and the process repeated. The third color can be obtained in the same manner. A metal layer (or pattern) can be obtained in the same manner.

The imaging method can be carried out using either a single-head printing apparatus or a dual-head printing apparatus in which either head can be used to image one or both sides of the substrate. The duplex thermal dye transfer receiver element is generally transported in the printing operation using capstan rollers before, during, or after forming the image. In some instances, the duplex thermal dye transfer receiver element is disposed within a rotating carousel that is used to position either side of the duplex thermal dye transfer receiver element in relationship with the printing head for imaging. In this manner, a clear film or metal patterned or coated layer can be transferred to either or both sides, along with the various transferred color images.

The present invention provides at least the following embodiments and combinations thereof, but other combinations of features are considered to be within the present invention as a skilled artisan would appreciate from the teaching of this disclosure:

1. A duplex thermal dye transfer receiver element comprising a substrate and on both surfaces, the following layers in the same order:

a non-voided compliant layer, and a thermal dye image receiving layer, and optionally a skin layer on either or both sides of the non-voided compliant layer, wherein the extruded, non-voided compliant layer has a heat of fusion of up to and including 45 joules/g of compliant layer as determined in a temperature range of at least 25° C. and up to and including 147° C. by ASTM method D3418-08, and a tensile modulus value of at least $7\times10^7$ and up to and including $5\times10^{10}$ dynes/cm$^2$.

2. The duplex thermal dye transfer receiver element of embodiment 1 wherein the non-voided compliant layer is an extruded, non-voided compliant layer, and has a heat of fusion of up to and including 30 joules/g of compliant layer and a tensile modulus value of at least $1\times10^9$ and up to and including $5\times10^{10}$ dynes/cm$^2$.

3. The duplex thermal dye transfer receiver element of embodiment 1 or 2 wherein the non-voided compliant layer comprises uni- or biaxially-oriented polypropylene, poly (ethylene terephthalate), or poly(lactic acid) in an amount of at least 75 weight % based on total dry layer weight.

4. The duplex thermal dye transfer receiver element of embodiment 3 wherein the non-voided compliant layer comprises an elastomeric resin in an amount of up to and including 25 weight %, based on total dry layer weight.

5. The duplex thermal dye transfer receiver element of embodiment 3 or 4 further comprises an extruded layer between the substrate and the non-voided compliant layer, and an aqueous-coated layer between the non-voided compliant layer and the thermal dye image receiving layer, the aqueous-coated layer optionally including an antistatic agent.

6. The duplex thermal dye transfer receiver element of embodiment 1 or 2 wherein the non-voided compliant layer is an extruded non-voided compliant layer that comprises at least one elastomeric resin in an amount of at least 5 weight %, and at least one amorphous or semi-crystalline polymer in an amount of at least 2 weight %.

7. The duplex thermal dye transfer receiver element of any of embodiments 1, 2 or 6 wherein the non-voided compliant layer is an extruded non-voided compliant layer that comprises at least 35 and up to and including 80 weight % of a matrix polymer, and comprises at least 5 and up to and including 30 weight % of the elastomeric resin and at least 2 and up to and including 25 weight % of the amorphous or semi-crystalline polymer.

8. The duplex thermal dye transfer receiver element of embodiment 7 wherein the elastomeric resin is a thermoplastic polyolefin blend, styrene/alkylene block copolymer, polyether block polyamide, thermoplastic copolyester elastomer, polyolefin, or thermoplastic urethane, or a mixture thereof.

9. The duplex thermal dye transfer receiver element of any of embodiments 1 to 8 further having an extruded skin layer immediately adjacent each side of the non-voided compliant layer.

10. The duplex thermal dye transfer receiver element of embodiment 9 wherein the extruded skin layers and non-voided compliant layer are co-extruded layers.

11. The duplex thermal dye transfer receiver element of any of embodiments 1 to 10 wherein the substrate comprises raw paper stock comprising an antistatic agent.

12. The duplex thermal dye transfer receiver element of any of embodiments 1 to 11 wherein the thermal dye image receiving layer and the non-voided compliant layers are co-extruded layers.

13. An assembly comprising the duplex thermal dye transfer receiver element of any of embodiments 1 to 12 in thermal association with a thermal dye donor element.

14. A method of forming a thermal dye image comprising imaging the duplex thermal dye transfer receiver element of any of embodiments 1 to 13 in thermal association with a thermal dye donor element.

15. The method of embodiment 14 wherein forming an image is carried out on both sides of the duplex thermal dye transfer receiver element using a single-head printing apparatus and as the duplex thermal dye transfer receiver element is disposed within a rotating carousel.

16. The method of embodiment 14 or 15 further comprising transporting the duplex thermal dye transfer receiver element using capstan rollers either before, after, or both before and after image forming.

17. The method of any of embodiments 14 to 16 wherein forming an image is carried out on both sides of the duplex thermal dye transfer receiver element using a dual-head printing apparatus wherein each head is designed to print either or opposite sides of the duplex thermal dye transfer receiver element.

18. The method of embodiment 17 further comprising transporting the duplex thermal dye transfer receiver element using capstan rollers either before, after, or both before and after image forming.

19. The method of embodiment 17 or 18 wherein the duplex thermal dye transfer receiver element is disposed within a rotating carousel.

20. The method of any of embodiments 14 to 19 further comprising transferring a clear film onto either or both sides of the duplex thermal dye transfer receiver element.

21. The method of any of embodiments 14 to 20 further comprising transferring a metal onto either or both sides of the duplex thermal dye transfer receiver element to form a metal patterned or coated layer.

22. The method of embodiment 21 further comprising transferring the metal patterned or coated layer over a thermal dye image.

The following Examples are provided to illustrate the present invention and are not meant to be limiting in any manner.

EXAMPLES

A dye receiving layer formulation was prepared and used in the duplex thermal dye transfer receiver elements described below. Polyester E-2 (branched polyester prepared as described in U.S. Pat. No. 6,897,183, Col. 15, lines 3-32) that is incorporated herein by reference, was dried in a desiccant dryer at 43° C. for 24 hours. Lexan® 151 polycarbonate (General Electric), Lexan® EXRL1414TNA8A005T polycarbonate (General Electric), and MB50-315 silicone (Dow Chemical Co.) were mixed together at a 0.819:1:0.3 weight ratio and dried at 120° C. for 2-4 hours. Dioctyl sebacate (DOS) was preheated to 83° C. and phosphorous acid was mixed in to make a phosphorous acid concentration of 0.4 weight %, and the mixture was maintained at 83° C. and mixed for 1 hour under nitrogen.

These components were then used in a compounding operation using a Leistritz ZSK 27 extruder with a 30:1 length to diameter ratio. The mixture of polycarbonates and silicone were introduced into the compounder first and melted. Then the dioctyl sebacate/phosphorous acid solution was added, and finally the branched polyester was added. The final formulation contained 73.46 weight % of branched polyester, 8.9 weight % of Lexan® 151 polycarbonate, 10 weight % of Lexan® EXRL1414TNA8A005T, 3 weight % of MB50-315 silicone, 5.33 weight % of DOS, and 0.02 weight % of phosphorous acid. A vacuum was applied with slightly negative pressure and the melt temperature was 240° C. The melted formulation was then extruded through a strand die, cooled in 32° C. water, and pelletized. The pellets were then aged for about 2 weeks and predried before their use in extrusion in desiccated air at 38° C. for 24 hours.

The following extruded compliant layers were prepared for both sides of the substrate of the various duplex thermal dye transfer receiver elements using the following components:

"811A LDPE" represents low density polyethylene that can be obtained from Westlake Chemical.

"Amplify™ EA102" and "Amplify™ EA103" are poly (ethylene-co-ethyl acetates) that can be obtained from Dow Chemical.

"P9HM015" is primarily a polypropylene that can be obtained from Flint Hills Corporation.

"EA3710" (or MC3700) represents polystyrene that can be obtained from Americas Styrenics.

Vistamaxx™ 6202 is a poly(ethylene-co-propylene) that was obtained from Exxon Mobil.

Kraton® G1657 is a thermoplastic elastomer that was obtained from Kraton Corporation.

"Topas® 5013X-14S" is a cyclic polyolefin copolymer that was obtained from Topas Corporation.

The $TiO_2$ used was rutile titanium dioxide.

A "tie" layer is another name for an extruded subbing layer (or slip layer) as described below. For the examples, the tie layer used was composed of poly(ethylene-co-ethyl acrylate), Amplify™ EA103, and has 19.5% ethyl acrylate and a melt flow rate of 21 (190° C., 2.16 Kg, ASTM D1238). This layer was used to adhere the dye receiving layer formulation on both sides of the substrate.

Comparative Example 1

A photographic cellulosic raw base having a 170 μm thickness and a wire side (backside) coating of unpigmented polyethylene at a coverage of 14.65 g/m$^2$ was used as a substrate. On the imaging side, a monolayer structure was created by extrusion coating a compliant resin layer against a matte chill roll. This compliant resin layer was composed of 89.75 weight % of 811A LDPE, 10 weight % of $TiO_2$, 0.25 weight % of zinc stearate, and 0.1 weight % of Irganox® 1076 antioxidant that was created by compounding in a Leistritz ZSK27 compounder. The total compliant layer dry coverage was 24.4 g/m$^2$. The substrate was coated on the imaging side with the extruded subbing (tie) layer and the dye receiving layer formulation. The dry thickness ratio of the dye receiving layer to tie layer was 2:1.

Comparative Example 2

A wire side resin-coated photographic raw base as described in Comparative Example 1 was extrusion coated on the imaging side against a matte chill roll with a compliant layer formulation composed of 89.75 weight % of Amplify™ EA103, 10 weight % of $TiO_2$, 0.25 weight % of zinc stearate, and 0.1 weight % of Irganox® 1076 antioxidant for a total coverage of 24.4 g/m$^2$. The compliant layer formulation was created by compounding in the Leistritz ZSK27 compounder. The created substrate was coated on the imaging side with an extruded subbing (tie) layer and dye receiving layer to provide a layer ratio of the dye receiving layer to tie layer of 2:1.

Comparative Example 3

A photographic raw base (160 g/m$^2$ basis weight) is laminated on both sides with commercially available Oppalyte RTM K18 TWK (ExxonMobil) that is a laminate (37 μm thickness, specific gravity of 0.62) consisting of a microvoided and oriented poly(propylene) core (about 73% of the thickness) with a titanium dioxide-pigmented, non-microvoided, oriented poly(propylene) layer on each side. The void-initiating material was poly(butylene terephthalate). More details for this laminate are in U.S. Pat. No. 5,244,861 (Campbell et al., Col. 3, line 24 to Col. 6, line 62) that is incorporated herein by reference. An aqueous-based subbing layer having the formulation described below was applied by gravure to the outermost surfaces of the laminate described above. Onto this subbing layer, the dye receiving layer formulation (extruded 2.2 g/m$^2$ coverage) was coated onto both sides to create a duplex thermal dye transfer receiver element with a voided compliant layer.

Aqueous-Based Subbing Layer Formulation:

This formulation contained NeoRez® R600 (30% weight dispersion of polyurethane latex, Tg of 32° C., DSM Neoresins), Polymer A (10% weight aqueous dispersion of poly (butyl acrylate-co-amynoethyl methacrylate hydrochloride-co-2-hydroxyethyl methacrylate at 50/5/45 weight ratio, Tg of −16° C.) as described in U.S. Pat. No. 6,077,656 (Majumdar et al., Ins. 28-31, Col. 9), FS 10D (20% weight aqueous dispersion of antimony-doped conductive tin oxide from Ishihara Corp.), and Ludox® AM (30% weight aqueous dispersion of alumina modified colloidal silica, DuPont).

Invention Example 1

A duplex thermal dye transfer receiver element of this invention was prepared as follows. A photographic cellulosic raw base 170 μm in thickness (same as that used in comparative examples) was extrusion coated against a matte chill roll with a compliant resin layer on both the sides at a coverage of 24.4 g/m$^2$. The compliant layer was composed of 53.6 weight % of Amplify® EA103 resin, 25.05 weight % of Kraton® G1657 resin, 11 weight % of P9H8M015 polypropylene, 10 weight % of $TiO_2$, 0.25 weight % of zinc stearate, and 0.1 weight % of Irganox® 1076 antioxidant. The compliant layer was created by compounding in a Leistritz ZSK27 compounder. The created substrate was coated on both sides with an extruded subbing (tie) layer and a dye receiving layer as described above to provide a dry layer ratio of the dye receiving layer to tie layer of 2:1.

Invention Example 2

A duplex thermal dye transfer receiver element of this invention was prepared like that of Invention Example 1 except that the compliant layer was composed of 53.6 weight % of Amplify® EA102 resin, 25.05 weight % of Kraton® G1657 resin, 11 weight % P9H8M015 polypropylene, 10 weight % $TiO_2$, 0.25 weight % of zinc stearate, and 0.1 weight % of Irganox® 1076 antioxidant to provide a coverage of 24.4 g/m$^2$. The created substrate was coated on the imaging side with an extruded subbing (tie) layer and dye receiving layer to provide a dry layer ratio of the dye receiving layer to the tie layer of 2:1.

Invention Example 3

A duplex thermal dye transfer receiver element of this invention was prepared like that of Invention Example 1 except that the compliant layer was composed of 53.6 weight % of Amplify® EA102 resin, 25.05 weight % of Kraton® G1657 resin, 11 weight % EA3710 (a polystyrene, PS), 10 weight % $TiO_2$, 0.25 weight % of zinc stearate, and 0.1 weight % of Irganox® 1076 antioxidant to provide a coverage of 24.4 g/m$^2$. The created substrate was coated on both sides with an extruded subbing (tie) layer and dye receiving layer to provide a dry layer ratio of the dye receiving layer to the tie layer of 2:1.

Invention Example 4

A duplex thermal dye transfer imaging element of this invention was prepared like that of Invention Example 1 except that the compliant layer was co-extruded with the dye receiving layer (with no intermediate skin layer or extruded subbing layer) against a glossy chill roll. The dye receiving layer was in contact with chill roll and had a coverage of 2.2 g/m$^2$. The compliant layer was composed of 53.6 weight % of Amplify® EA102 resin, 25.05 weight % of Kraton® G1657 resin, 11 weight % of PS, 10 weight % of $TiO_2$, 0.25 weight % of zinc stearate, and 0.1 weight % of Irganox® 1076 antioxidant to provide a coverage of 24.4 g/m$^2$.

Invention Example 5

A duplex thermal dye transfer imaging element of this invention was prepared like that of Invention Example 1 except that the compliant layer on the imaging side was created by co-extrusion with the dye receiving layer against a glossy chill roll. There was no intermediate extruded subbing (tie) layer. The dye receiving layer was extruded at a coverage was 6.59 g/m$^2$. The compliant layer was composed of 53.6 weight % of Amplify® EA102 resin, 25.05 weight % of Kraton® G1657 resin, 11 weight % of PS, 10 weight % $TiO_2$, 0.25 weight % of zinc stearate, and 0.1 weight % of Irganox® 1076 antioxidant to provide a coverage of 24.4 g/m$^2$.

Invention Example 6

For this example, a paper core was laminated on both the image receiving side and the backside side with ExxonMobil's Bicor 70 MLT non-microvoided polypropylene film or non-microvoided biaxially oriented polypropylene laminate (18 μm thick with a specific gravity of 0.9) as a compliant layer. This film is a multilayered film and has multiple resin components. This results in a film or laminate that has on one side a matte finish and the other side is smooth and has been treated. The lamination on imaging side was carried out in a way that the treated side was farther away from the raw base substrate. The created substrate was coated on the imaging side with the extruded tie layer and dye receiving layer to provide a layer thickness ratio of 1:2. The compliant layer (the multilayer film) had a heat of fusion of 11.89 Ng and a tensile modulus of $8.06\times10^9$ dynes/cm$^2$.

TABLE I

| Imaging Element | Support Coating on Imaging Side | Total Heat of Fusion * (J/g) | Tensile Modulus * (dynes/cm$^2$) 25° C. | Image Defects |
|---|---|---|---|---|
| Comparative Example 1 | Low density polyethylene | 93.17 | $8.08\times10^8$ | Poor print quality; many print defects ("white" spots**) |
| Comparative Example 2 | Compliant Layer (EA 103 + $TiO_2$) | 66.7 | $1.94\times10^8$ | Some "white" spots; less than Comparative Example 1 |
| Invention Example 1 | Compliant layer (EA103, Kraton ® G1657, PP, & $TiO_2$) | 36.41 | $2.92\times10^8$ | Good print quality with no print defects |
| Invention Example 2 | Compliant layer (EA102, Kraton ® G1657, PP, & $TiO_2$) | 45.73 | $4.02\times10^8$ | Good print quality with no print defects |
| Invention Example 3 | Compliant layer (EA102, Kraton ® G1657, PS, & $TiO_2$) | 40.03 | $1.2\times10^8$ | Good print quality with no print defects |

* Properties of Support Coating (compliant layer)
***"White spots" are also known as "drop-outs" where no image is present

TABLE II

| Imaging Element | Support Coating on Imaging Side | Skin Layer *** | Dye Receiving Layer (g/m$^2$) | Total Heat of Fusion * (J/g) | Print Defects |
|---|---|---|---|---|---|
| Invention Example 3 | Compliant layer (EA102, Kraton ® G1657, PS, & $TiO_2$) | Yes | 2.2 | 36.42 | Good print quality with no print defects |
| Invention Example 4 | " | No | " | 36.97 | |
| Invention Example 5 | Compliant layer (EA102, Kraton ® G1657, PS, & $TiO_2$) | No | 6.59 | 32.61 | " " |

* Sum of Support Coating and skin layer (if any) and dye receiving layer on either side of the cellulosic raw base
*** Located between dye image receiving layer and compliant layer

TABLE III

| Imaging Element | Tensile Modulus* (dynes/cm$^2$) 25° C. | Total Heat of Fusion* (J/g) | $D_{max}$ Dye Density Change (% with respect to Comparative Example 1) |
|---|---|---|---|
| Comparative Example 1 | $8.08\times10^8$ | 93.17 | — |
| Invention Example 3 | $1.2\times10^8$ | 40.03 | 17.2% |
| Invention Example 6 | $8.06\times10^8$ | 11.89 | 46.1% |

*Properties of Support Coating (compliant layer)

TABLE III lists the change in $D_{max}$ print density data for the standard set of printing conditions using a Kodak® 3480 on a Kodak® 6850 printer. Sixteen measurements of D. were taken and the change in print density as a function of total heat of fusion and tensile modulus are reported here. The data in TABLE III demonstrate that with a decrease in the heat of fusion, there is an increase in dye transfer efficiency (Invention Example 3 versus Comparative Example 1). Furthermore, a decrease in the heat of fusion and an increase in tensile modulus (Invention Example 9 versus Comparative Example 1) enhance the dye transfer efficiency. Thus, the best dye transfer efficiency occurs when extruded, non-voided compliant layer has a heat of fusion of from 0 to 30 joules/g of compliant layer and a tensile modulus value of from $1\times10^9$ to $5\times10^{10}$ dynes/cm$^2$.

To further illustrate the advantages of the present invention in thermal printing, some of the duplex thermal dye receiver elements were printed in a thermal printer which enabled two sided (duplex) printing. This printer had two resistive thermal print heads and capstan rollers for transport of each duplex thermal dye receiver element through the printer. While the first side image is being printed, the second side of the thermal dye receiver element (unprinted state) is in intimate contact with a capstan roller. The printer has been designed such that capstan rollers come in contact at about 2 inches (about 5 cm) from either edge of each thermal dye receiver element. The footprint of the capstan roller (width of area contacted by the capstan roller) was about 2 inches (about 5 cm).

The following procedure was used to evaluate the impact of capstan rollers on page-size printed images in thermal dye receiver elements having a non-voided compliant layer versus page-size printed images in duplex thermal dye receiver elements having a voided laminate (Comparative example 3). Test targets were printed on one (first) side of the duplex thermal dye receiver element using the first print head in the thermal printer, and then the same test target was printed on the opposite (second) side of the duplex thermal dye receiver element using the second print head in the thermal printer. The test target was an image of uniform density across the entire printed image. The test target image on the opposite (second) side of the duplex thermal dye receiver element was evaluated for difference in lightness (L*) from center of printed to the region where the capstan roller comes into contact with the duplex thermal dye receiver element. As is well known, L* is also a measure of density (image density). The desired result across the printed image is a low L* value since a customer should not notice a difference in image uniformity across the printed image, as one measure of image quality.

TABLE IV summarizes the change in L* (ΔL*) or the difference in uniformity from the center of the printed image to the area where capstan comes in contact with initially unprinted opposite (second) side of the duplex thermal dye receiver element. There will be two ΔL* values, one ΔL* value for the capstan roller near the left edge of the duplex thermal dye receiver element and the other ΔL* value for the capstan roller near the right edge of the duplex thermal dye receiver element. Each ΔL* value is an average of three data points.

TABLE IV

| Duplex Thermal Dye Receiver Element | Left ΔL* | Right ΔL* |
|---|---|---|
| Comparative Example 3 (with voided laminate compliant layer) | 4.46 | 4.84 |
| Invention Example 4 | 0.94 | 0.48 |
| Invention Example 6 | 1.32 | 1.39 |

From the data in TABLE 1V, it is clearly seen that duplex thermal dye receiver element having a voided laminate compliant layer exhibited 3-5 times higher ΔL* than that of the duplex thermal dye receiver elements of the present invention. These results indicate that the printed image in the comparative elements was not acceptable and had poor quality.

The invention has been described in detail with particular reference to certain preferred embodiments thereof, but it will be understood that variations and modifications can be effected within the spirit and scope of the invention.

The invention claimed is:

1. A duplex thermal dye transfer receiver element comprising a substrate and on both surfaces, the following layers in the same order:

a non-voided compliant layer, and a thermal dye image receiving layer, and optionally a skin layer on either or both sides of the non-voided compliant layer, wherein the extruded, non-voided compliant layer has a heat of fusion of up to and including 45 joules/g of compliant layer as determined in a temperature range of at least 25° C. and up to and including 147° C. by ASTM method D3418-08, and a tensile modulus value of at least $7\times10^7$ and up to and including $5\times10^{10}$ dynes/cm$^2$.

2. The duplex thermal dye transfer receiver element of claim 1 wherein the non-voided compliant layer is an extruded, non-voided compliant layer, and has a heat of fusion of up to and including 30 joules/g of compliant layer and a tensile modulus value of at least $1\times10^9$ and up to and including $5\times10^{10}$ dynes/cm$^2$.

3. The duplex thermal dye transfer receiver element of claim 1 wherein the non-voided compliant layer comprises mono- or biaxially-oriented polypropylene, poly(ethylene terephthalate), or polylactic acid) in an amount of at least 75 weight % based on total dry layer weight.

4. The duplex thermal dye transfer receiver element of claim 3 wherein the non-voided compliant layer comprises an elastomeric resin in an amount of up to and including 25 weight %, based on total dry layer weight.

5. The duplex thermal dye transfer receiver element of claim 3 further comprises an extruded layer between the substrate and the non-voided compliant layer, and an aqueous-coated layer between the non-voided compliant layer and the thermal dye image receiving layer, the aqueous-coated layer optionally including an antistatic agent.

6. The duplex thermal dye transfer receiver element of claim 1 wherein the non-voided compliant layer is an extruded non-voided compliant layer that comprises at least one elastomeric resin in an amount of at least 5 weight %, and at least one amorphous or semi-crystalline polymer in an amount of at least 2 weight %.

7. The duplex thermal dye transfer receiver element of claim 1 wherein the non-voided compliant layer is an extruded non-voided compliant layer that comprises at least 35 and up to and including 80 weight % of a matrix polymer, and comprises at least 5 and up to and including 30 weight % of the elastomeric resin and at least 2 and up to and including 25 weight % of the amorphous or semi-crystalline polymer.

8. The duplex thermal dye transfer receiver element of claim 7 wherein the elastomeric resin is a thermoplastic polyolefin blend, styrene/alkylene block copolymer, polyether block polyamide, thermoplastic copolyester elastomer, polyolefin, or thermoplastic urethane, or a mixture thereof.

9. The duplex thermal dye transfer receiver element of claim 1 further having an extruded skin layer immediately adjacent each side of the non-voided compliant layer.

10. The duplex thermal dye transfer receiver element of claim 9 wherein the extruded skin layers and non-voided compliant layer are co-extruded layers.

11. The duplex thermal dye transfer receiver element of claim 1 wherein the substrate comprises raw paper stock comprising an antistatic agent.

12. The duplex thermal dye transfer receiver element of claim 1 wherein the thermal dye image receiving layer and the non-voided compliant layers are co-extruded layers.

13. An assembly comprising the duplex thermal dye transfer receiver element of claim 1 in thermal association with a thermal dye donor element.

14. A method of forming a thermal dye image comprising imaging the duplex thermal dye transfer receiver element of claim 1 in thermal association with a thermal dye donor element.

15. The method of claim 14 wherein forming an image is carried out on both sides of the duplex thermal dye transfer receiver element using a single-head printing apparatus and as the duplex thermal dye transfer receiver element is disposed within a rotating carousel.

16. The method of claim 15 further comprising transporting the duplex thermal dye transfer receiver element using capstan rollers either before, after, or both before and after image forming.

17. The method of claim 14 wherein forming an image is carried out on both sides of the duplex thermal dye transfer receiver element using a dual-head printing apparatus wherein each head is designed to print either or opposite sides of the duplex thermal dye transfer receiver element.

18. The method of claim 17 further comprising transporting the duplex thermal dye transfer receiver element using capstan rollers either before, after, or both before and after image forming.

19. The method of claim 17 wherein the duplex thermal dye transfer receiver element is disposed within a rotating carousel.

20. The method of claim 14 further comprising transferring a clear film onto either or both sides of the duplex thermal dye transfer receiver element.

21. The method of claim 14 further comprising transferring a metal onto either or both sides of the duplex thermal dye transfer receiver element to form a metal patterned or coated layer.

22. The method of claim 21 further comprising transferring a thermal dye image over the metal patterned or coated layer.

23. The method of claim 14 wherein the duplex thermal dye transfer receiver element comprises a non-voided compliant layer that comprises mono- or biaxially-oriented polypropylene, poly(ethylene terephthalate), or poly(lactic acid) in an amount of at least 75 weight % based on total dry layer weight.

24. The method of claim 14 wherein the duplex thermal dye transfer receiver element comprises a non-voided compliant layer that is an extruded non-voided compliant layer that comprises at least 35 and up to and including 80 weight % of a matrix polymer, and comprises at least 5 and up to and including 30 weight % of the elastomeric resin and at least 2 and up to and including 25 weight % of the amorphous or semi-crystalline polymer.

* * * * *